United States Patent [19]

Autry et al.

[11] Patent Number: 4,594,798

[45] Date of Patent: Jun. 17, 1986

[54] SHOE HEEL COUNTER CONSTRUCTION

[75] Inventors: James C. Autry, Dallas, Tex.; Lin Yung-Mao, Taichung, China

[73] Assignee: Autry Industries, Inc., Dallas, Tex.

[21] Appl. No.: 737,519

[22] Filed: May 24, 1985

[51] Int. Cl.[4] ..... A43B 23/17; A43B 23/08

[52] U.S. Cl. ..... 36/68; 36/69; 36/114

[58] Field of Search ..... 36/68, 69, 114, 45, 36/72 B; 12/146 D

[56] References Cited

U.S. PATENT DOCUMENTS

| | | | |
|---|---|---|---|
| 353,740 | 12/1886 | Erdman | 36/68 |
| 1,102,113 | 6/1914 | White | 36/68 |
| 2,095,613 | 10/1937 | Ornsteen | 36/68 |
| 2,301,836 | 11/1942 | Wilcox | 36/68 |
| 2,742,715 | 4/1956 | Meltzer | 36/68 |
| 2,875,533 | 3/1959 | Ham et al. | 36/68 |
| 3,046,582 | 7/1962 | Blustein | 36/68 |

FOREIGN PATENT DOCUMENTS

| | | | |
|---|---|---|---|
| 1368621 | 6/1964 | France | 36/114 |

*Primary Examiner*—Werner H. Schroeder
*Assistant Examiner*—Steven N. Meyers
*Attorney, Agent, or Firm*—Jerry W. Mills; Gregory M. Howison

[57] ABSTRACT

The specification discloses a shoe counter having a first leather counter portion (12) hingedly connected to a second leather counter portion (14) by a hinge (20). Hinge (20) is formed of synthetic plastic and is stitched to counter portions (12) and (14) in order to conform to the shape of the wearer's heel while providing support and flexibility.

12 Claims, 3 Drawing Figures

SHOE HEEL COUNTER CONSTRUCTION

TECHNICAL FIELD OF THE INVENTION

This invention relates generally to athletic shoes and more specifically to an improved heel counter construction for athletic shoes suitable for running and jogging.

BACKGROUND OF THE INVENTION

Present athletic and jogging shoes are normally fabricated of soft, pliable, lightweight material which enables an individual to exercise without adding to the stress of the exercise through heavier, more rigid shoes. Prior shoes have, however, in some instances failed to provide the necessary support for various surfaces of the foot, specifically the heel, which can cause discomfort if not supported during exercise. Previous athletic shoes have also failed to adequately laterally stabilize the heel during exercise. In an effort to provide heal support and stabilization, previously developed jogging shoes have incorporated plastic heel counters, but such rigid counters do not conform to the surface of the wearer's heel. With such prior shoes, the wearer's heel will thus typically move up and down within the shoe rear as the wearer exercises, thereby contacting the back heel portion of the shoe and tending to abrade the skin of the heel.

It has been observed that most runners are rear foot strikers. Thus in the normal cycle of foot movement during running, the back of the athlete's heel will contact the ground first and thus the greatest amount of stress will be concentrated in the heel region. It is especially important, therefore, that the heel of the runner's foot be adequately supported and that it be stabilized against excessive movement, while not sliding within the shoe heel.

SUMMARY OF THE INVENTION

The present invention provides a heel counter for an athletic shoe which improves upon the prior art and provides support as well as a stabilizing effect at the heel where it is most needed. The heel counter is fabricated from multiple regions which are hinged to provide enhanced flexibility in the heel region. Additionally, as the wearer exercises, the two regions conform to the heel of the foot and will grip the heel to prevent it from slipping.

The present invention described and disclosed herein comprises an improved heel counter which is of a two-piece construction and comprises a first region of material adapted to be disposed proximate to the heel to surround the heel of the foot and hingedly connected to a second region of material. The hinge portion is formed from a padded flexible member stitched to the first and second regions. This two-piece hinged construction provides flexibility in the heel counter portion which is absent in one-piece heel counters and thus prevents the heel from "breaking down" or collapsing over a period of extended wear. In addition, the two hinged regions conform to the heel of the wearer and grip the heel to prevent it from moving.

In the preferred embodiment, the hinge portion includes a raised cord adapted to protrude through an elongated aperture formed between the first and second regions to provide a decorative affect as well as a hinge function.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
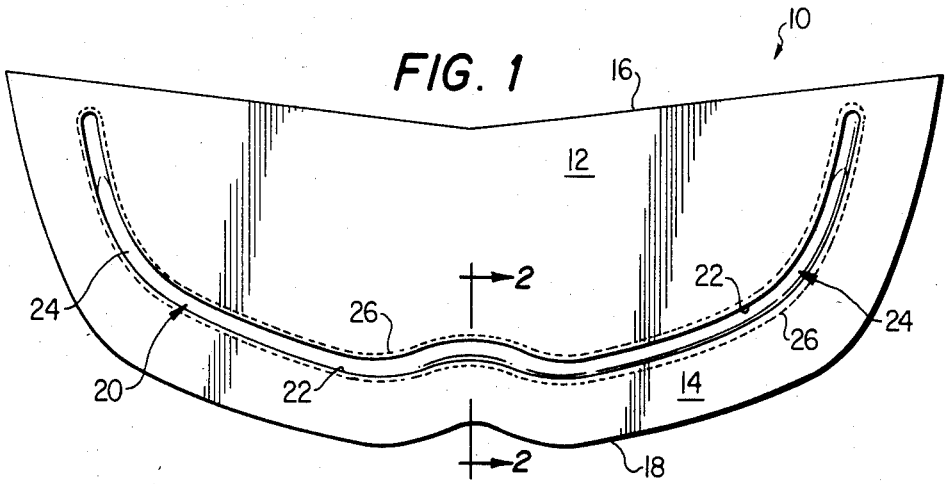
FIG. 1 is an elevational view of the heel counter of the present invention.

Referring now to the Drawings wherein like-referenced numerals designate like or corresponding parts throughout the view, FIG. 1 illustrates the heel counter 10 of the present invention. Heel counter 10 is of a two-piece construction and comprises a first region of material 12 and a second region of material 14 hingedly secured thereto. Regions 12 and 14 are configured to be disposed proximate the heel of the foot and, when incorporated into an athletic shoe, are adapted to be attached to the sole along edge 16 and to the shoe upper along edge 18 to thus surround the heel of the foot. Regions 12 and 14 are formed from natural full grain leather treated for relative stiffness.

A hinge 20 is disposed and connected between regions 12 and 14 in order to provide flexibility. Hinge 20 is formed from a slit 22 which separates regions 12 and 14. A padded hinge member 24 is stitched at stitch lines 26 to regions 12 and 14.

Figure 2:
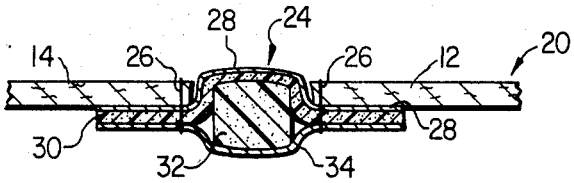
FIG. 2 is a sectional view of the heel counter of FIG. 1 taken along lines 2—2 in the direction of the arrows.

FIG. 2 illustrates a cross section of the hinge 20. A coated polyurethane layer 28 is colored a different color from the leather regions 12 and 14 to provide decoration. Layer 28 is affixed to a padding layer 30 constructed from a synthetic foam. A nylon cord 32 is enclosed between layer 30 and a cotton mesh filler backing 34. Layers 28, 30 and 34 are glued together and layer 28 is glued to regions 12 and 14. The regions 12 and 14 are stitched to the hinge 20 along stitch lines 26.

Hinge 20 provides flexibility to counter 10, while regions 12 and 14 are sufficiently stiff to provide heel support. The hinge 20 enables the counter 10 to conform to the shape of the wearer's heel. Nylon cord 32 provides padding to the hinge 20 and added flexibility. The construction of the hinge 20 enables firm connection between the two leather regions 12 and 14.

Figure 3:
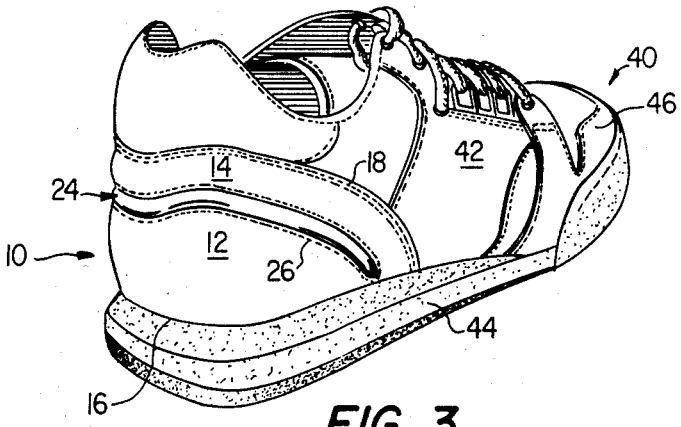
FIG. 3 is a perspective view of an athletic shoe incorporating the present heel counter.

FIG. 3 is a perspective view of an athletic shoe 40 incorporating the heel counter 10 of the present invention. The athletic shoe 40 comprises an upper 42 and an outsole 44 attached to the upper and cooperating therewith to enclose the foot of the wearer. Upper 42 is preferably formed of leather or vinyl plastic and comprises a toe portion 46 overlaying the toes of the foot, a mid portion disposed to overlay the arch of the foot, and the heel counter 10 overlaying and surrounding the heel of the foot.

As shown in FIG. 3, heel counter 10 is fixedly secured at the lower edge 16 thereof to the rear of outsole 44. Edge 16 is folded under and glued and/or stitched to the top of outsole 44. Counter 10 is thus curved around the rear of outsole 44 so as to surround the heel, and the counter 10 is also secured along the upper edge 18 to the upper 42. Additional layers will normally be affixed to the backing 34 to provide comfort to the wearer's foot.

The two-piece construction of heel counter 10 provides enhanced flexibility in the heel area proximate the attachment points of the first and second layers. This flexibility prevents the heel from breaking down or collapsing over a period of extended wear. In addition, in practice as the athlete exercises, the two layers of material will conform to the heel of the wearer and will grip the heel to prevent it from slipping.

What is claimed is:

1. A shoe counter comprising:

first and second counter portions spaced apart and shaped to conform to the heel of the wearer, said counter portions sufficiently stiff to provide support to the wearer's heel, a hinge formed of relatively flexible material connected between said counter portions to better conform to the wearer's heel while providing flexibility to the counter.

2. The shoe counter of claim 1 wherein said counter portions are formed from leather and said hinge is constructed from synthetic plastic material stitched to said counter portions.

3. The shoe counter of claim 1 wherein said hinge is formed in and across a slit spacing apart said counter portions and extending along the width of said counter.

4. The shoe counter of claim 1 wherein said hinge includes a flexible cord disposed along the length of said slit.

5. The shoe counter of claim 1 wherein said hinge comprises an outer layer of flexible plastic material, a second layer of padding, a flexible elongated cord and a mesh backing.

6. The shoe counter of claim 5 wherein said outer layer has a different color than said first and second regions.

7. A shoe counter for being connected in the heel portion of a shoe between a sole and an upper comprising:

a first counter portion formed of stiff material connected at the bottom thereof to the sole, said first counter portion conforming to the heel of the wearer, a second counter portion formed of stiff material and conforming to the upper portion of the heel of the wearer, said first and second counter portions substantially spaced apart to form an elongated slit, and a hinge formed of flexible material and connected to said first and second counter portions in and across said elongated slit, said second counter portion connected along its upper edge to the upper.

8. The shoe counter of claim 7 wherein said counter portions are formed from leather and said hinge is constructed from synthetic plastic material stitched to said counter portions.

9. The shoe counter of claim 7 wherein said hinge includes a flexible cord disposed along the length of said slit.

10. The shoe counter of claim 7 wherein said hinge comprises an outer layer of flexible plastic material, a second layer of padding, a flexible elongated cord and a mesh backing.

11. The shoe counter of claim 10 wherein said outer layer has a different color than said first and second regions.

12. The shoe counter of claim 7 wherein said first and second counter portions are stitched along opposite sides of said hinge.

* * * * *